US009033163B2

(12) United States Patent
Hsu

(10) Patent No.: US 9,033,163 B2
(45) Date of Patent: May 19, 2015

(54) CURVED SHOWER ROD ASSEMBLY HAVING FLEXIBLE MOUNTING BASE

(71) Applicant: Test Rite Products Corp., Ontario, CA (US)

(72) Inventor: Ming-Hsien Hsu, Taipei (TW)

( * ) Notice: Subject to any disclaimer, the term of this patent is extended or adjusted under 35 U.S.C. 154(b) by 0 days.

(21) Appl. No.: 13/953,755

(22) Filed: Jul. 30, 2013

(65) Prior Publication Data

US 2015/0034581 A1 Feb. 5, 2015

(51) Int. Cl.

| | |
|---|---|
| ***A47H 1/122*** | (2006.01) |
| ***A47H 1/022*** | (2006.01) |
| ***A47H 1/142*** | (2006.01) |
| *A47H 1/02* | (2006.01) |

(52) U.S. Cl.

CPC ..... *A47H 1/122* (2013.01); *A47H 1/022* (2013.01); *A47H 1/142* (2013.01); *A47H 2001/0205* (2013.01)

(58) Field of Classification Search

CPC ..... A47H 1/00; A47H 1/02; A47H 1/022; A47H 1/03; A47H 1/04; A47H 1/08; A47H 1/12; A47H 1/122; A47H 1/14; A47H 1/142; A47H 2001/0205; A47K 3/38

USPC ..... 211/105.1, 105.2, 105.3, 105.4, 105.5, 211/105.6, 119.009, 119.011, 123; 4/558, 4/610

See application file for complete search history.

(56) References Cited

U.S. PATENT DOCUMENTS

| | | | | | |
|---|---|---|---|---|---|
| 428,783 | A * | 5/1890 | Reubel et al. | ..... | 248/262 |
| 485,270 | A * | 11/1892 | Gaines | ..... | 248/262 |
| 502,659 | A * | 8/1893 | Day | ..... | 248/262 |
| 517,620 | A * | 4/1894 | Morris | ..... | 248/262 |
| 734,059 | A * | 7/1903 | Grainger | ..... | 248/262 |
| 819,588 | A * | 5/1906 | Palmer | ..... | 248/262 |
| 1,046,728 | A * | 12/1912 | Boye | ..... | 248/262 |
| 3,204,898 | A * | 9/1965 | Manning | ..... | 248/516 |
| 5,794,281 | A | 8/1998 | Shearon | | |
| 5,894,610 | A | 4/1999 | Winter | | |
| 6,216,287 | B1 | 4/2001 | Wise | | |
| 6,694,543 | B2 * | 2/2004 | Moore | ..... | 4/610 |
| 7,171,705 | B1 | 2/2007 | Hicks | | |
| 7,222,376 | B1 * | 5/2007 | Gunning | ..... | 4/610 |
| 7,346,940 | B1 * | 3/2008 | Liao | ..... | 4/558 |
| 7,762,508 | B2 | 7/2010 | Xu | | |
| 7,926,127 | B2 | 4/2011 | Barrese | | |
| 7,958,577 | B2 * | 6/2011 | Chang | ..... | 4/610 |
| 8,069,508 | B2 | 12/2011 | OConnell | | |

(Continued)

*Primary Examiner* — Joshua Rodden

(74) *Attorney, Agent, or Firm* — Treasure IP Group, LLC

(57) ABSTRACT

An adjustable curved shower curtain rod assembly, attached to the walls to form different sizes of shower area, has a telescopic curtain rod and a pair of flexible mounting bases, including a pair of flexible mounting adapters. Each adapter has a supporting cover coaxially secured to the mounting bracket through a lock mechanism; a flexible joint, consisting of a female joint cover and male joint insert, the male point insert is substantially spherically shaped and the joint cover, having a spherical central opening, encapsulates the joint insert partially; and an insertion post, projecting from the joint insert, having an outer thread on an outer surface thereof capable of being inserted into one of the curved curtain rod, wherein the joint insert can move to allow the moveable insertion post change positions pivotally, from a position parallel to the surface to a position having an increasing angle to the surface, or from a position perpendicular to the surface to a position having a decreasing angle to the surface, while the joint insert smooth fits in the joint cover.

10 Claims, 14 Drawing Sheets

(56) References Cited

U.S. PATENT DOCUMENTS

| | | | | |
|---|---|---|---|---|
| 8,146,182 | B2 * | 4/2012 | Bauer | 4/558 |
| 8,166,583 | B1 * | 5/2012 | Liang | 4/610 |
| 8,185,981 | B2 | 5/2012 | Didehvar et al. | |
| 8,205,760 | B2 * | 6/2012 | Chang | 211/105.3 |
| 8,214,938 | B2 | 7/2012 | Hanley et al. | |
| 8,341,775 | B2 | 1/2013 | Didehvar | |
| 2007/0006377 | A1 * | 1/2007 | Moore | 4/558 |
| 2011/0000051 | A1 * | 1/2011 | Liang | 16/94 R |
| 2011/0247133 | A1 | 10/2011 | Mange et al. | |
| 2012/0074085 | A1 * | 3/2012 | Chang | 211/105.3 |
| 2012/0187063 | A1 * | 7/2012 | Bauer | 211/123 |
| 2013/0269099 | A1 * | 10/2013 | Chang | 4/610 |
| 2014/0131298 | A1 * | 5/2014 | Didehvar et al. | 211/105.2 |

* cited by examiner

CURVED SHOWER ROD ASSEMBLY HAVING FLEXIBLE MOUNTING BASE

TECHNICAL FIELD OF THE DISCLOSURE

This U.S. patent application relates, in general, to the art of curved shower curtain mounting systems and more particularly, to a curved shower rod having a flexible ball socket mounting system.

BACKGROUND OF THE DISCLOSURE

In general, a shower curtain mounting system is preferred to have a beautiful appearance and to be easy to assemble and mount. In addition, houses in highly populated areas often do not offer shower areas in uniform sizes or dimensions. Occasionally the opposing walls, where the shower rods are to be mounted, are not necessarily parallel to each other. It is important to design a shower rod that can fit various sizes of shower spaces and still meet all the other requirements.

Recently curved shower rods have become widely used because they direct the shower curtains away from the shower space, effectively increasing the space of the shower area.

U.S. Pat. No. 8,069,508 discloses a movable curved shower rod, having the rod extendable in length. But the mounting system taught by U.S. Pat. No. 8,069,508 is rather complicated, involving more than a dozen parts.

A simpler, yet, versatile shower rod system, which can fit in various shower areas is needed.

SUMMARY

In view of the foregoing, disclosed herein is a novel curved shower rod system, having a pair of flexible mounting bases. The flexible mount allows for varying degrees of angles created by size differences and configurations in shower areas.

Said flexible mounting base includes a mounting bracket and a mounting adapter. The mounting brackets have a plurality of through holes so as to be mounted on a surface by multiple screws. The mounting adapter includes a supporting cover coaxially secured to the mounting bracket through a lock mechanism, and a flexible joint, consisting of a female joint cover and male joint insert, having the male joint insert substantially spherically shaped and the joint cover, having a spherical central opening and a circular opening, encapsulate the joint insert partially in appearance but completely contain the joint insert in the joint cover mechanically; and an insertion post, projecting from the joint insert, having an outer thread on an outer surface thereof capable of being inserted into one end of the curved curtain rod; wherein the joint insert can move to allow the moveable insertion post change positions pivotally, from a position parallel to the surface to a position having an increasing angle to the surface, or from a position perpendicular to the surface to a position having a decreasing angle to the surface, while the joint insert still smoothly fits in the joint cover.

In one aspect of the present invention, the curved shower rod can offer stable horizontal swivel angles up to 180 degrees.

In another aspect of the present invention, the insertion post has thread on an outer surface thereof and two flat sides so that the curved shower rod stays parallel to the ground.

BRIEF DESCRIPTION OF THE DRAWINGS

Exemplary embodiments of the disclosure will be more clearly understood from the following detailed description taken in conjunction with the accompanying drawings in which.

DETAILED DESCRIPTION OF SELECTED EXAMPLES

Figure 1:
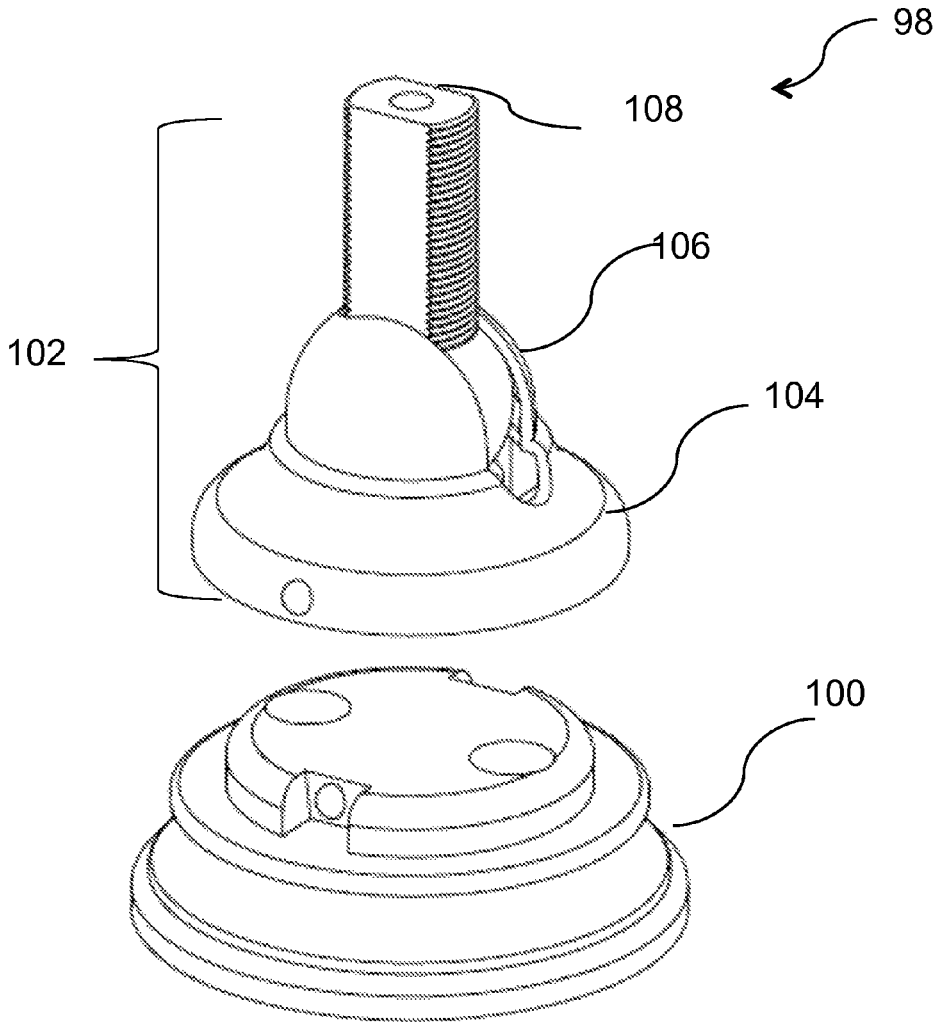
FIG. 1 is a perspective view of the shower rod mounting base, wherein the mounting bracket and flexible mounting adapter is de-attached.

Hereinafter, selected examples of shower rods, mounting brackets and flexible joints will be discussed in the following with reference to the accompanying drawings. It will be appreciated by those skilled in the art that the following discussion is for demonstration purposes, and should not be interpreted as a limitation. Other variances within the scope of this disclosure are also applicable.

Aspects of the present invention are disclosed in the following description and related figures directed to specific embodiments of the invention. Those skilled in the art will recognize that alternate embodiments may be devised without departing from the spirit or the scope of the claims. Additionally, well-known elements of exemplary embodiments of the invention will not be described in detail or will be omitted so as not to obscure the relevant details of the invention.

As used herein, the word "exemplary" means "serving as an example, instance, or illustration." The embodiments described herein are not limiting, but rather are exemplary only. It should be understood that the described embodiments are not necessarily to be construed as preferred or advantageous over other embodiments. Moreover, the term "embodiments of the invention" does not require that all embodiments of the invention include the discussed feature, advantage or mode of operation.

The present invention provides a curved shower rod assembly having flexible mounting bases. The flexible mounting bases include a mounting base, covered by a decorative cover. Said flexible mounting bases offer the shower rod, attached therefrom, a stable horizontal angle up to 180 degrees, Said mounting base and the shower assembly are very easy to install on walls to match other bath hardware and traditional bath hardware fixtures.

In the figures, the following reference numerals are utilized with the respective elements:

98, flexible mounting base

100, mounting bracket

102, mounting adapter

104, supporting cover (or supporting cap)

106, flexible joint

108, insertion post

300, curved shower rod

500, through hole on the mounting bracket

600, concave slot on the side of the mounting bracket

700, through hole in the concave slot on the side of the mounting bracket

1000, through hole in the convex slot on the inner side of the supporting cover

1002, female joint cover of the flexible joint in the mounting base

1004, spherical central opening of the female joint cover of the flexible joint

1500, male portion of the flexible joint

1502, flat side of the insertion post

1504, round side of the insertion post, having thread on the outer surface thereof

1506, a slot

1600, a trench on the surface for users to easily screw the flexible joint into the tube(s) of the shower rod The present invention includes a flexible mounting base for curved shower rods. The flexible mounting base 98 is illustrated in FIG. 1. Said mounting base 98 has mounting bracket 100 and a mounting adapter 102. The mounting adapter 102 further comprises a mounting support cover 104, a flexible joint 106 and an insertion post 108. The mounting bracket 100 is secured to the wall directly and one end of the adapter is connected to the mounting bracket and the other end of the mounting adapter is secured to the curved shower rod.

Figure 2A:
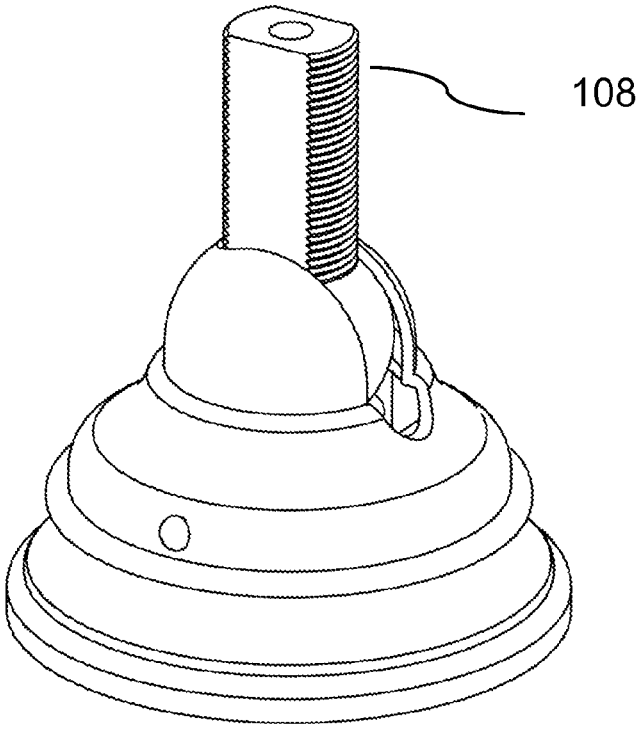
FIG. 2*a* is a perspective view of the shower rod mounting base, wherein the mounting bracket and flexible mounting adapter are attached, and the insertion post is in the upright position with respect to the mounting bracket.
Figure 2B:
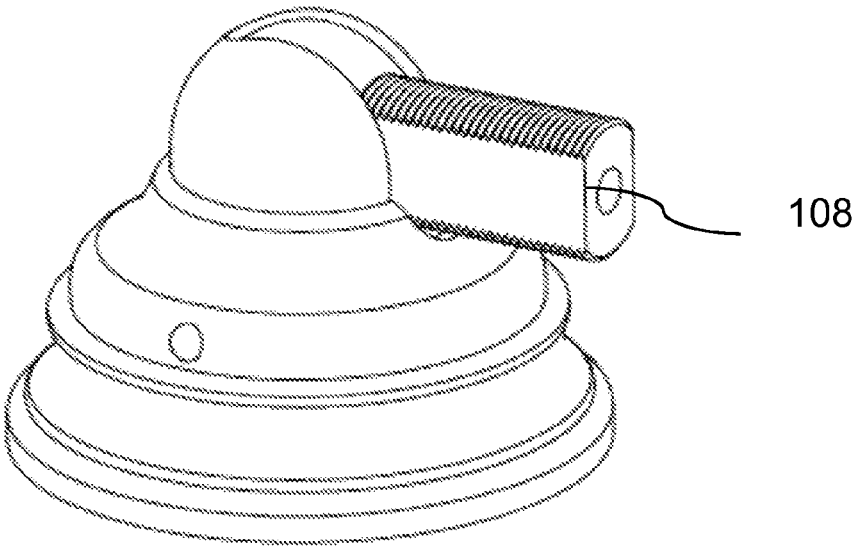
FIG. 2*b* is a perspective view of the shower rod mounting base, wherein the mounting bracket and flexible mounting adapter is attached, and the insertion post is in the horizontal position with respective to the mounting bracket.

The flexible joint includes a female joint cover and female joint insert. The joint insert is further connected to an insertion post 108, projecting therefrom. Referring to FIGS. 2*a* and 2*b*. The insertion post 108 can freely move in a plane perpendicular to the mounting surface, from 0-180 degrees.

Figure 3:
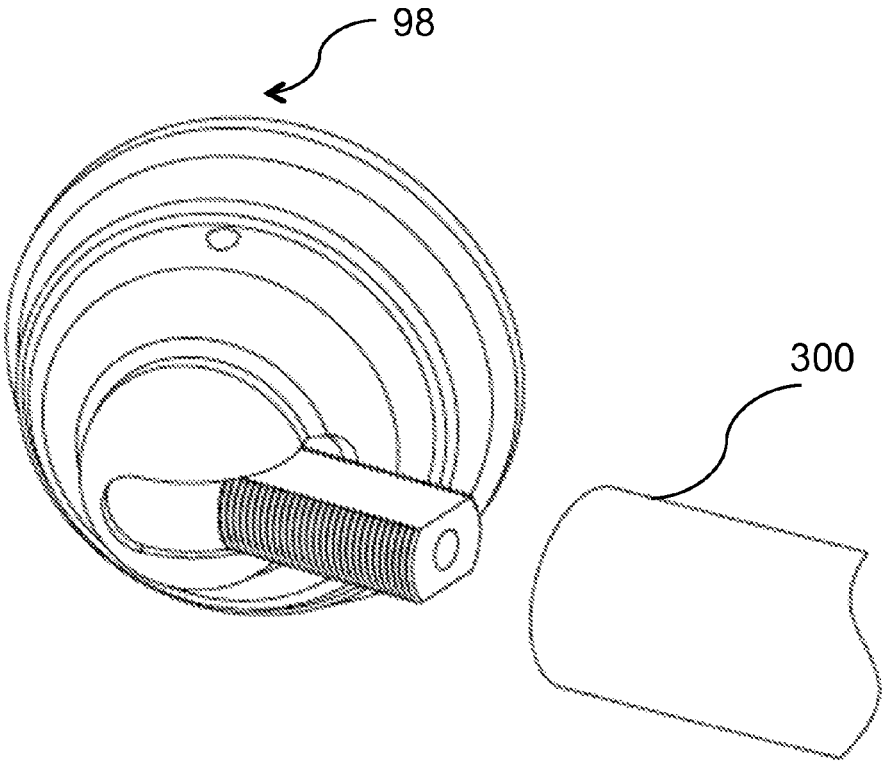
FIG. 3 is an exemplary perspective view of the shower rod mounting base, wherein the shower rod mounting base is in its use position and a shower rod is ready to be inserted onto the insertion post.

FIG. 3 further illustrates that in one exemplar embodiment, when a consumer installs the shower rod system, the mounting base 98 are first assembled and installed onto the wall and the shower rod is subsequently inserted onto the insertion post. When the joint insert and insertion post move, the attached shower rod swivel correspondingly. The flexible joint disclosed in the present invention, offers stable horizontal swivel angles up to 270 degrees. The flexible joint and the mounting brackets, shown in FIGS. 1-3 allow for varying degrees of angles created by size differences in consumer shower application.

Further, customer shower application requires mounting systems have aesthetic values. Shown in FIGS. 1-4, the mounting adapter, alone or attached to the mounting to bracket, is substantially bell shaped. The bell shape design is not only aesthetically appealing but match with other shower equipment in the shower area as well.

Figure 4:
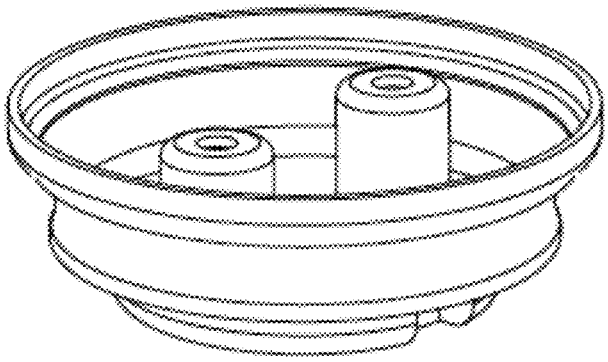
FIG. 4 is a bottom perspective view of the shower rod mounting bracket as shown in FIG. 1.
Figure 5:
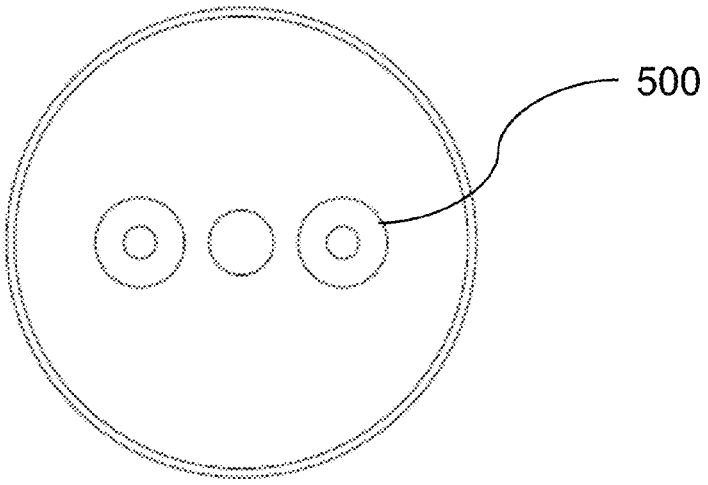
FIG. 5 is a bottom view of the shower rod mounting bracket as shown in FIG. 4.
Figure 6:
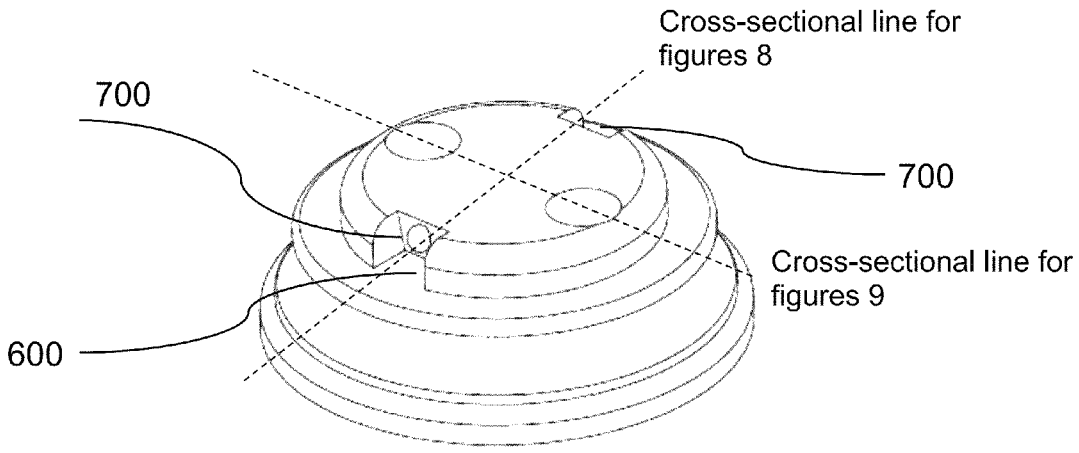
FIG. 6 is a top perspective view of the shower rod mounting bracket as shown in FIG. 1.
Figure 7:
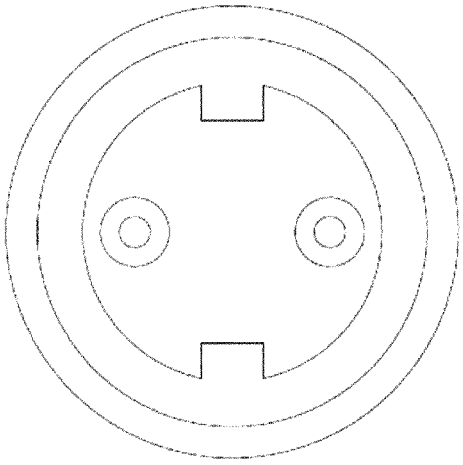
FIG. 7 is a top view of the shower rod mounting bracket as shown in FIG. 6.
Figure 8:
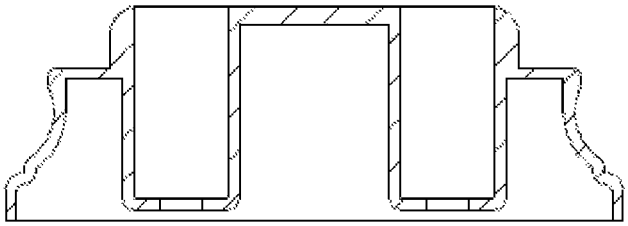
FIG. 8 is a cross-section view of the shower rod mounting bracket as shown in FIG. 6.
Figure 9:
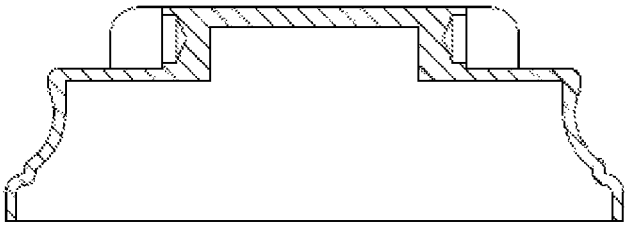
FIG. 9 is another cross-section view of the shower rod mounting bracket as shown in FIG. 6.
Figure 10:
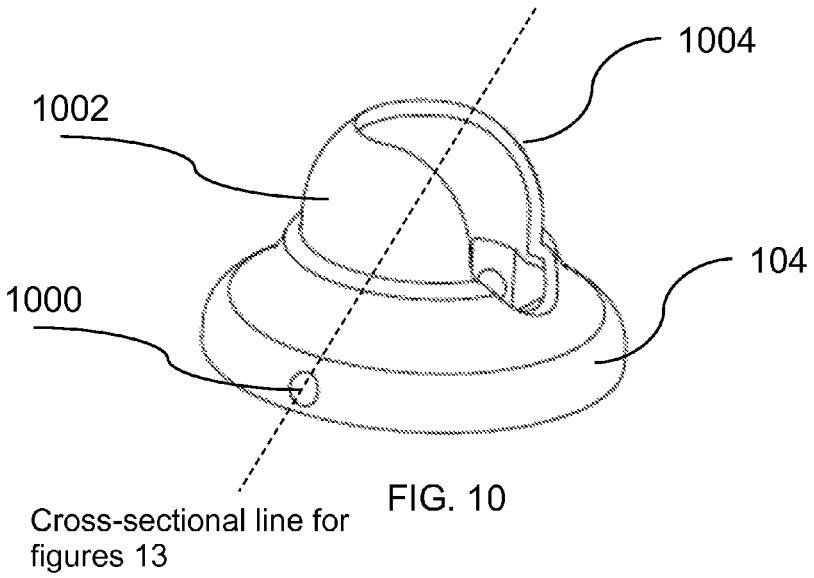
FIG. 10 is a side perspective view of the support cover as shown in FIG. 1, viewing from the top.
Figure 11:
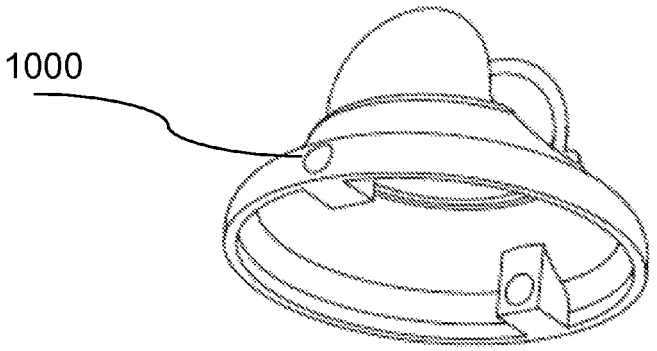
FIG. 11 is a side perspective view of the support cover as shown in FIG. 1, viewing from the bottom.
Figure 12:
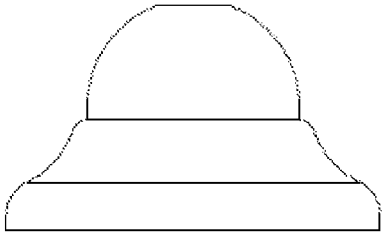
FIG. 12 is a left side view of the support cover connected with the female joint cover of the flexible joint as shown in FIG. 1.
Figure 13:
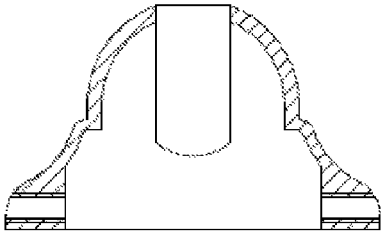
FIG. 13 is a cross-sectional view of the support cover connected with the female joint cover of the flexible joint as shown in FIG. 1.
Figure 14:
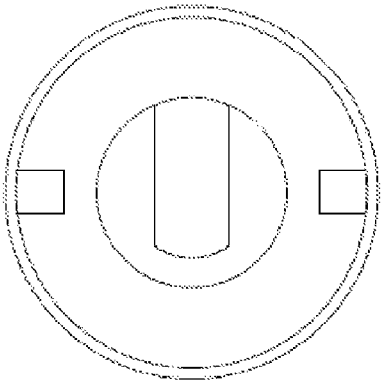
FIG. 14 is a bottom view of the support cover connected with the female joint cover of the flexible joint as shown in FIG. 1.
Figure 15:
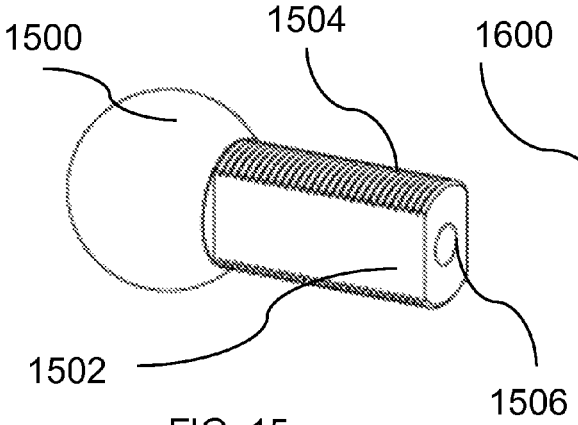
FIG. 15 is a side perspective view of the male portion of the flexible joint as shown in FIG. 2*b*, viewing from the right.
Figure 16:
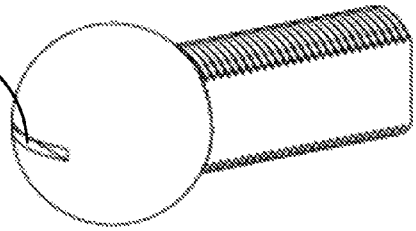
FIG. 16 is a side perspective view of the male portion of the flexible joint as shown in FIG. 2*b*, viewing from the left.
Figure 17:
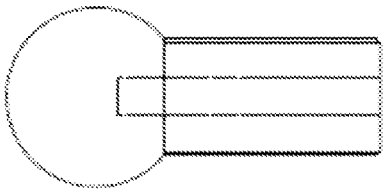
FIG. 17 is a front view of the part of flexible joint as shown in FIG. 15.
Figure 18:
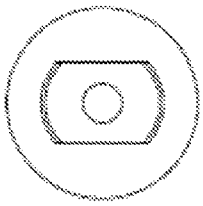
FIG. 18 is a right side view of the part of flexible joint as shown in FIG. 15.

FIG. 4 is a bottom perspective view of the shower rod mounting bracket as shown in FIG. 1; FIG. 5 is a bottom view of the shower rod mounting bracket as shown in FIG. 4; FIG. 6 is a top perspective view of the shower rod mounting bracket as shown in FIG. 4; FIG. 7 is a top view of the shower rod mounting bracket as shown in FIG. 6; FIG. 8 is a cross-section view of the shower rod mounting bracket as shown in FIG. 6; and FIG. 9 is another cross-section view of the shower rod mounting bracket as shown in FIG. 6. FIGS. 4-9 have provided exemplar detailed structure information of the mounting brackets. As shown, the bottom of the mounting bracket is substantially round. At least two through holes 500 are positioned symmetrically on different sides of the center of the circular base, allowing the bracket to be secured to a wall or a hard surface. Preferably, as shown in the cross section view of FIG. 8, the two through holes are not only symmetrical but have the same depth. In addition, the top of the mounting bracket is designed to receive the supporting cover 104 as a cap and the supporting cover 104 is capped onto the base through a lock means. As illustrated in FIG. 1 and FIG. 11 both the top of the mounting bracket and the bottom of the support cover 104 are threaded, so that the supporting can be fastened onto the mounting bracket. Further, a through hole 700 is located on each side of the top portion of the mounting base and support cover (1000, in FIG. 10), so both the support cover and mounting bracket can be tightened using screws or nails. Additionally, a pair of concave slots are symmetrically positioned on the sides of mounting brackets, across the center point and the pair of through holes 700 are located in the concave slots, while precisely matching the pair of through holes 1000 located in the convex slots on the bottom of the supporting cover 104, as illustrated in FIG. 11. When the supporting cover 104 is places on top of the mounting bracket 100 as shown in FIGS. 2 and 3, a pair of screws are used to drill through the holes 700 and 1000 to strongly tighten the supporting cover with the mounting bracket.

FIGS. 10-14, show the detailed structure of the support cover and the female joint cover of the flexible joint. The support cover 104 and female joint cover 1002 of the flexible joint 106 is an integral part. Said integral part is substantially bell shaped. The female joint cover of the flexible joint 1002 is hollow and can be smoothly fitted with the ball shaped joint insert 1500. The female joint cover of the flexible joint has a spherical central opening 1004, crossing the central axis of the sphere or the support cover.

FIGS. 15-18 provide detailed structural information about the male portion of the flexible joint 1500 and the insertion post 1502. The male portion of the flexible joint 1500 and the insertion post 1502 are one integral part. The male portion of the flexible joint can not only fit into the space provided by the female joint cover of the joint, but can also bear the distributed weight of shower rod when the female and male portions of the joint are fixed together. Male joint insert 1504 is fixed onto the insertion post 1504 permanently. The insertion post 1504 is a modified cylinder, having a hollow center toward the end. The modified cylinder 1504 has two round sides and two flat sides, with one flat side neighboring to a round side. The round sides have threads on the outer surface thereof The two flat sides are specifically engineered to insure the curved shower rod stays parallel to the ground when the rod is attached to the insertion post. The insertion post 1500 further comprise an indentation, groove or a trench 1600, in 1-1.6 mm in width, engraved onto the ball surface of 1500. Such a trench or indentation allows for better fitting between the male and female joint cover of the flexible joint and offers more smooth rotation and/or swiveling of the insert 1500 in the 1002, by leaving a little air space. More importantly, the trench 1600 on the ball surface of 1500 allows users easily screw the flexible joint into the tube(s) of the shower rod.

Figure 19:
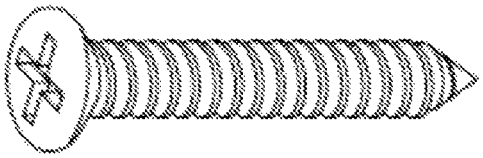
FIG. 19 is a front perspective view of an exemplar screw used to secure mounting bracket to a surface.
Figure 20:
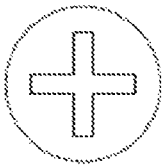
FIG. 20 is a left side view of the exemplar screw shown in FIG. 19.
Figure 21:
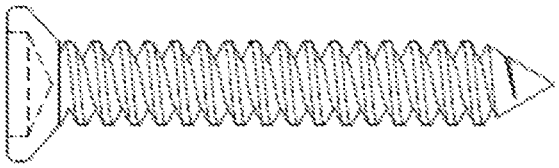
FIG. 21 is a front side view of the exemplar screw shown in FIG. 19.
Figure 22:
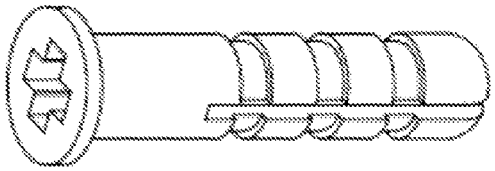
FIG. 22 is front perspective view of an exemplar expansion nail that may be used together with the exemplar screw, shown in FIG. 19.
Figure 23:
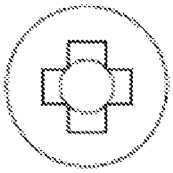
FIG. 23 is a left side view of the expansion nail shown in FIG. 22.
Figure 24:
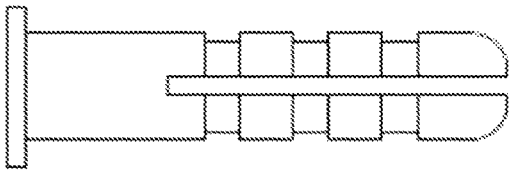
FIG. 24 is a front side view of the expansion nail shown in FIG. 22.

FIGS. 19-21 provide examples of the screws used to mounting the bracket onto a wall or hard surface. FIG. 22-24 provide expansion nails to be used together with the screws to make the mounting bracket hold more weight when they are mounted as a pair on the wall.

Figure 25:
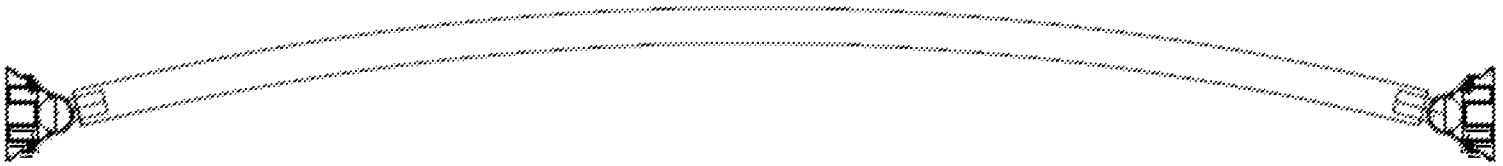
FIG. 25 is a perspective view of the shower rod assembly having a telescopic rod with the minimum possible length by sliding about 98% of the inner tube into the outer tube.
Figure 26:
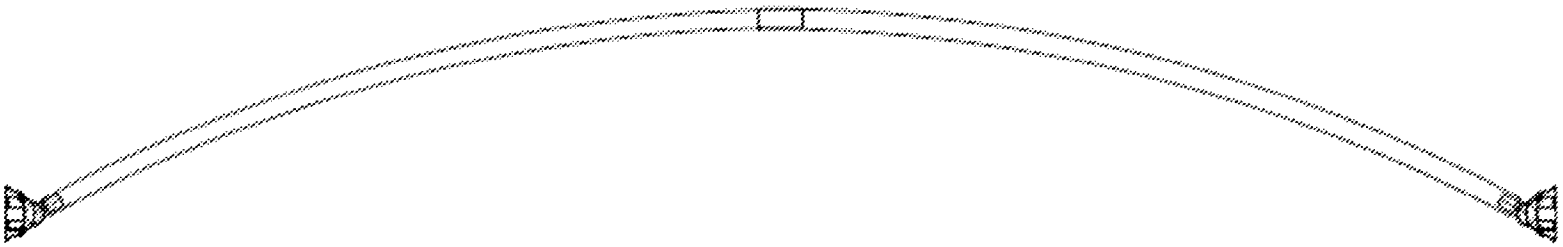
FIG. 26 is a perspective view of the shower rod assembly having a telescopic rod with the maximum possible length by sliding about 5% of the inner tube into the outer tube.
Figure 27:
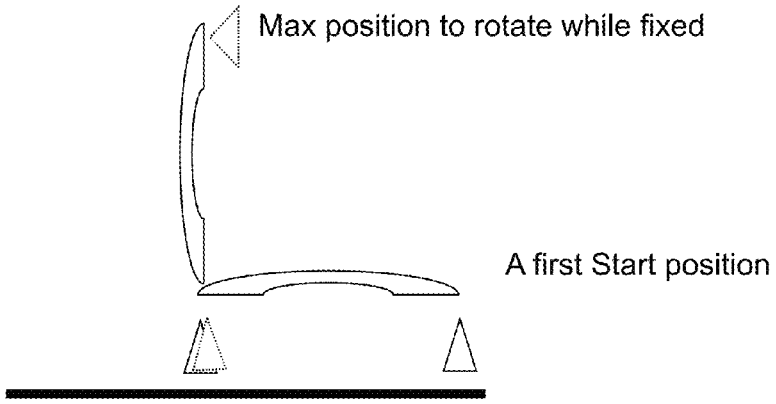
FIGS. 27-28 are schematic illustrations of an exemplary embodiment wherein the shower rod can turn between 0-180 degrees with respect to a mounting surface.
Figure 28:
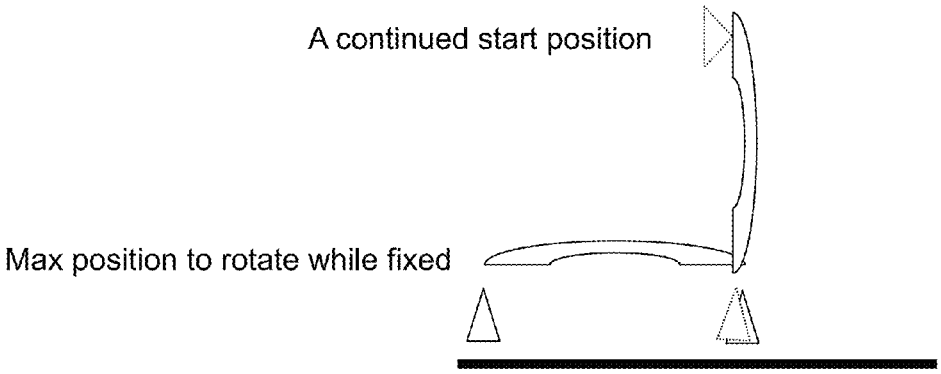

FIGS. 25-26 provide perspective views of the entire curved shower assembly. The assembly further comprises a shower rod, which is telescopic or extendable. The telescopic shower rod includes two detachable rods, a curved inner tube and a curved outer tube, sleeved with each other so as to adjust the length of the curved telescopic rod; each of two ends of the curved telescopic rod is connected to each moveable insertion post and is arranged so that the curved telescopic rod is fastened and fixed on the mounting adapter. Preferably, the inner tube has the same length as the outer tube. In one example, the telescopic shower rod has the minimum length, where the inner tube is about 98% slid into the outer tube, leaving only one end element exposed to be attached to an insertion post. In another example, the telescopic shower rod has the maximum possible length, wherein about 5% of inner tube is sleeved in the outer tube, and the maximum linear length of the telescopic rod is 1.88 times of the minimum linear length of the curved shower rod.

It will be appreciated by those of skilled in the art that a new and useful shower rod mounting system has been described herein. In view of the many possible embodiments, however, it should be recognized that the embodiments described herein with respect to the drawing figures are meant to be illustrative only and should not be taken as limiting the scope of what is claimed. Those of skill in the art will recognize that the illustrated embodiments can be modified in arrangement and detail. Therefore, the systems as described herein contemplate all such embodiments as may come within the scope of the following claims and equivalents thereof. In the claims, only elements denoted by the words "means for" are intended to be interpreted as means plus function claims under 35 U.S.C. §112, the sixth paragraph.

What is claimed is:

1. A curved curtain rod assembly, comprising a curved curtain rod, a pair of mounting brackets, wherein each of the mounting brackets has a pair of through holes so as to be mounted on a surface by a pair of screws; and a pair of mounting adapters, each adapter comprising a supporting cover coaxially secured to a respective one of the mounting brackets through a lock mechanism;

a flexible joint, consisting of a female joint cover and a male joint insert, wherein the male joint insert is substantially spherically shaped and the joint cover, having a spherical central opening, encapsulates the joint insert partially; and an insertion post, projecting from the joint insert, having an outer thread on an outer surface thereof capable of being inserted into one end of the curved curtain rod;

wherein the joint insert can move to allow the insertion post to change positions pivotally from 0-180 degrees with respect to the surface, while the joint insert smoothly fits in the joint cover.

2. The assembly of claim 1, wherein when the insertion post is perpendicular to the surface, and the mounting adapter is substantially bell shaped.

3. The assembly of claim 1, wherein the curved curtain rod is a telescopic rod.

4. The assembly of claim 3, wherein the telescopic rod includes two detachable rods, a curved inner tube and a curved outer tube, sleeved with each other so as to adjust length of the telescopic rod; each of two ends of the telescopic rod is connected to each moveable insertion post and is arranged so that the curved telescopic rod is fastened and fixed on each of the mounting adapters.

5. The assembly of claim 1, wherein the spherical central opening of the female joint cover has an inner diameter larger than an outer diameter of the male joint insert so that the male joint insert is limited in an inner side of the central opening while the projecting insertion post passes through the central opening to an outer side, and moves and pivots.

6. The assembly of claim 1, wherein the female joint cover and supporting cover are a coaxially arranged integral part.

7. The assembly of claim 1, wherein the insertion post and male joint insert are one integral part.

8. The assembly of claim 3, wherein a maximum linear length of the rod is about 1.88 times a minimum linear length of the rod.

9. The assembly of claim 1, wherein the insertion post has two flat surfaces.

10. The assembly of claim 1, wherein the male joint insert further comprises a trench on the outer surface thereof, and the trench is substantially rectangular shaped, having a width between 1-1.6 mm.

* * * * *